United States Patent [19]

Ekström

[11] Patent Number: 4,604,846

[45] Date of Patent: Aug. 12, 1986

[54] ANCHORAGE DEVICE

[76] Inventor: Leif E. J. Ekström, Matterödsgaten 16, 282 00 Tyringe, Sweden

[21] Appl. No.: 699,511

[22] Filed: Jan. 29, 1985

[30] Foreign Application Priority Data

Feb. 10, 1984 [SE] Sweden ..... 8400713

[51] Int. Cl.[4] ..... E04B 1/38

[52] U.S. Cl. ..... 52/704; 52/410; 52/508; 411/546

[58] Field of Search ..... 52/410, 508, 698, 704, 52/711; 411/338, 339, 546; 403/167, 168, 305

[56] References Cited

U.S. PATENT DOCUMENTS

| | | | |
|---|---|---|---|
| 2,999,571 | 9/1961 | Huber | 52/508 X |
| 3,328,055 | 6/1967 | Lang | 403/167 X |
| 3,420,559 | 1/1969 | Schaefer | 411/338 X |
| 3,523,395 | 8/1970 | Rutter et al. | 52/410 |
| 3,970,210 | 7/1976 | Katsuta | 52/410 X |
| 4,040,222 | 8/1977 | Cull | 52/508 X |
| 4,157,001 | 6/1979 | Pickles | 52/410 X |
| 4,329,823 | 5/1982 | Simpson | 52/508 X |

*Primary Examiner*—Carl D. Friedman

*Attorney, Agent, or Firm*—Beveridge, DeGrandi and Weilacher

[57] ABSTRACT

The disclosure relates to a device for the anchorage of two spaced-apart elements (11, 13) to one another, which may consist of, for example, a wooden stud and an optional substrate or another wooden stud, for realising a space for, for example, insulation purposes, the elements being held in spaced-apart relationship by means of a spacer (2) which is anchored in the studs by means of a plug-like member (1) which is provided with snap-like locks (5, 6) for cooperation with snap-like locks (8, 9) on the spacer (2), the plug-like member (1) being cylindrical and having a foot (3) for abutment against the element (11, 13) and a through-hole (4) in its longitudinal direction for an anchorage device (12, 14) and the spacer (2) having, at its ends, a hole (7) for the plug-like member (1) which is dimensioned so as to fit into the hole (7).

7 Claims, 8 Drawing Figures

ANCHORAGE DEVICE

TECHNICAL FIELD

The present invention relates to a device for anchoring two spaced-apart elements to one another, of which one element is, for example, a wooden stud and the other element is, for example, another stud, a wall, a roof or the like, a plug-like member being fixed on or in the one element and a spacer being fixed on or in the other element, and the plug-like member and spacer being, at their ends, provided with snap-like devices for mutual cooperation and realising a possibly releasable engagement with one another for anchoring the plug-like member and the spacer, and their associated elements to one another.

BACKGROUND ART

In particular in the construction industry, it is often desirable to be able to place and anchor a batten or stud in spaced-apart relationship to a substrate or another batten or stud so as to realise a structure of lighter weight and better thermal insulation properties. Moreover, such a structure involves, on many occasions, considerably lower costs apart from the fact that versatility from the point of view of employment and dimensioning is greatly improved. Consequently, many attempts have been made within the art to realise a suitable such structure, for example the light stud described in Swedish Patent Application No. 8102568-6, which is essentially identical to the structure described in European Patent Application No. 80100063.9 and French Patent Specification No. 2267428. However, these prior art structures suffer from a number of drawbacks which primarily entail higher costs from the points of view of manufacture and use, and which, moreover, place restrictions on the versatility of the structures involved.

OBJECT OF THE PRESENT INVENTION

Thus, the task forming the basis of the present invention is to realise a device which constitutes an improvement on prior art structures without dectracting from those improvements already attained by such prior art structures.

SOLUTION

This task is solved according to the present invention in the device described by way of introduction, in that the plug-like member is cylindrical and has a foot for abutment against the element, and a through-hole in its longitudinal direction for a retaining member, for example a nail, screw, bolt or the like, and in that the spacer is, at its ends, provided with a hole for the plug-like member which is dimensioned so as to fit into these holes. One plug-like member is fixed in or on both elements and the spacer is, at both ends, designed for cooperation with the plug-like members. The plug-like member has a conical portion at its opposite end in relation to the foot, the section between the conical portion and the foot being of lesser diameter than the base diameter of conical portion, and the spacer being provided with a recess corresponding to the conical portion. The angle between the shoulder between the base of the conical portion and the web is larger than, equal to, or smaller than 90°, depending upon the desired anchorage engagement between the plug-like member and the spacer. Suitably, the spacer is tubular. Furthermore, the tubular spacer is in two parts, a connecting piece being provided between the two parts.

ADVANTAGES

By means of the device according to the present invention, it is an extremely simple operation to realise, for example, a light stud or light wall by quite simply providing the two battens or studs with plugs at suitable spaced-apart relationship, the plugs being nailed or screwed in place, and the spacer being thereafter placed between the plugs, whereupon the battens are urged towards one another until the snap locks come into engagement with each other. Similarly, it is an extremely simple operation to place a batten in spaced-apart relationship from any optional substrate for attaining, for example, a suitable insulation space. Plugs at suitable spaced-apart relationship are placed on the batten, whereafter plugs are then placed on the substrate. Finally, the spacers are placed between the plugs and the batten is urged against the substrate, until the snap locks comes into engagement with each other. In the event component parts of a device according to the present invention are manufactured of a suitable plastic material, these components may be produced in large numbers at an extremely low cost. Naturally, the device according to the present invention may also be used in any given context where it is desirable to realise anchorage of two elements to one another. Furthermore, the device according to the present invention makes it possible, in conjunction with both internal and external cladding, to place a batten or stud at a distance from a substrate for realising an insulation gap in any optionally desired position, irrespective of the presence of studs or beams in the substrate.

BRIEF DESCRIPTION OF THE ACCOMPANYING DRAWINGS

The nature of the present invention and its aspects will be more readily understood from the following brief description of the accompanying Drawings, and discussion relating thereto.

DESCRIPTION OF PREFERRED EMBODIMENT

Figure 3:
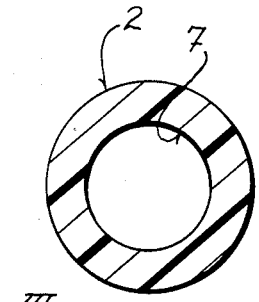
FIG. 3 is a cross section taken along the line III-III through the part illustrated in FIG. 2.
Figure 1:
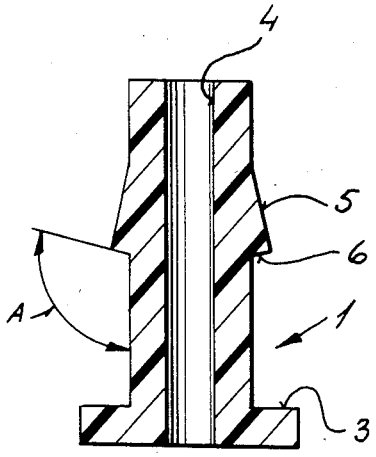
FIG. 1 is a longitudinal section through one part of a device according to one embodiment of the present invention.
Figure 2:
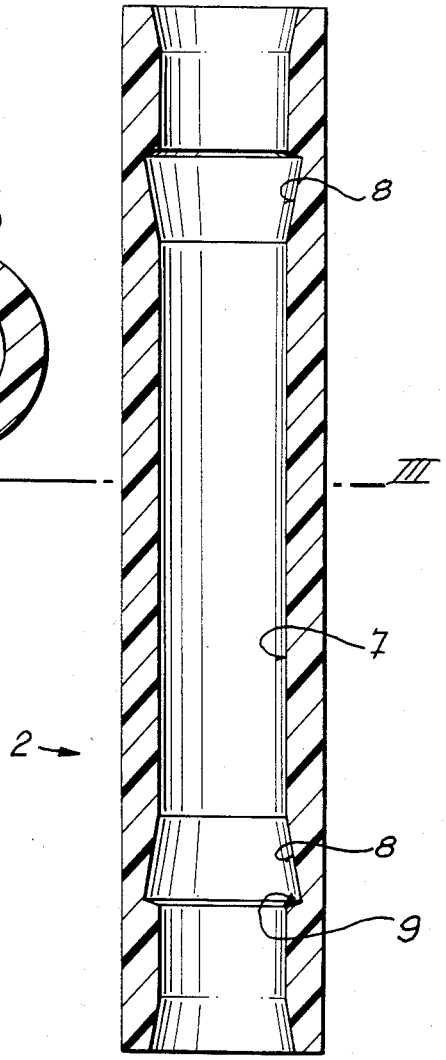
FIG. 2 is a longitudinal section through another part of the device as shown in FIG. 1.

The embodiment of the present invention illustrated in FIGS. 1 to 3 comprises a plug 1 and a spacer 2 whose physical application is more closely illustrated in FIGS. 4 to 8. In most applications, use is made of two plugs 1 and a spacer 2 extending between the plugs, the spacer being anchored in the plugs 1 by means of snap locks, whose nature will be illustrated in greater detail in the description below. The plugs 1 and the spacer 2 are preferably manufactured of a suitable plastic material, for example HD polyethylene, but it is, naturally, conceivable to manufacture these parts from other comparable materials which allow for the same fundamental function.

The plug is cylinderical and displays a foot portion 3 and a through-hole 4 in the longitudinal direction. Between its ends, the plug 1 has a conical portion 5 for forming a snap shoulder 6 facing towards the foot portion 3. According to FIG. 1, the angle A between the snap shoulder 6 and the web between the snap shoulder 6 and the foot portion 3 is greater than 90°, but this angle may varied optionally depending upon whether the snap lock engagement between the plug and the spacer 2 is to be releasable or not. The greater the angle A, the easier it is to release the snap lock engagement between the plug 1 and the spacer 2. Releasability of the snap lock engagement may also be facilitated by the provision of longitudinal slits in the plug 1 and/or the spacer 2 from the ends down into, and possibly through, the conical portion 5. The smaller the angle A, the more powerful will be the snap lock engagement between the plug 1 and the spacer 2. Finally, the engagement can be rendered more or less permanent by the application of a layer of a suitable glue on the plug 1 and/or in the spacer 2.

As will be apparent from FIG. 2, the spacer 2 is tubular, but the spacer may, of course, be of any optionally desired configuration, apart from the fact that, at its ends, it must display a recess with an internal configuration which agrees with the outer configuration of the plug 1. According to the illustrated and described embodiment, the spacer 2 is cylindrical and has a through-hole 7 in its longitudinal direction, which, at each end, has a recess 8 corresponding to the conical portion 5 on the plug 1. In a direction towards the end of the hole 7, the recess 8 has a snap shoulder 9 corresponding to the snap shoulder 6 on the plug 1. The snap shoulder 9 may be provided with the same angle A as the snap shoulder 6, but this is not a necessity, it being instead possible for the snap shoulder 9 to be arranged with such an angle as corresponds to the desired releasability or engagement force. At its ends, the hole 7 flares conically so as to facilitate alignment of the spacer 2 with the plug 1. The web of the plug 1 most proximal the foot 3 may have the same conicity as the entry to the hole 7, which leads to a higher degree of stability. Between the recesses 8, the spacer 2 has substantially uniform wall thickness, but this is not a necessity, the wall thickness being, instead, adaptable to meet different requirements.

As has been mentioned previously, a number of physical applications of the device according to the present invention described above are illustrated in FIGS. 4 to 8. Naturally, the device should not be considered as restricted to these applications, but enjoys a high degree of versatility in use as a connecting piece, anchorage device or spacer.

Figure 4:
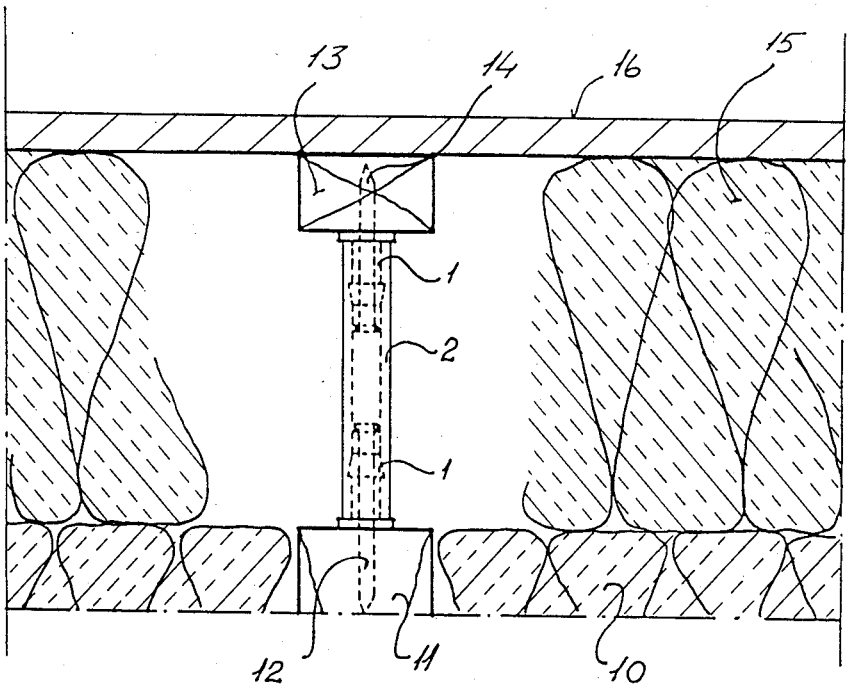
FIGS. 4–8 are partial sections through various applications of the parts according to the present invention as shown in FIGS. 1 to 3.

In the application shown in FIG. 4, the device according to the present invention is employed to realise a cladding for the supplementary insulation of a loft ceiling beam structure which is provided with insulation 10 and studs or beams 11. Plugs 1 are fixed on the beams 11 in suitable spaced-apart relationship, by means of nails 12. Plugs 1 are fixed on a stud or batten 13 with the same spacing as the plugs on the beams 11 by means of nails 14. Between the registering plugs 1, there is disposed a spacer 2, whereupon the parts are urged together until the plugs 1 snap into the snap locking positions in the spacer 2. Additional insulation is laid in the spaces created between the battens or studs, and a covering board 16 is then fixed in place on the battens or studs 13. Thus, thanks to the device according to the present invention, it is extremely simple to realise additional insulation with a minimum of cold bridges, since the additional insulation can extend in between the beams 11 and the new battens or studs 13.

Figure 5:
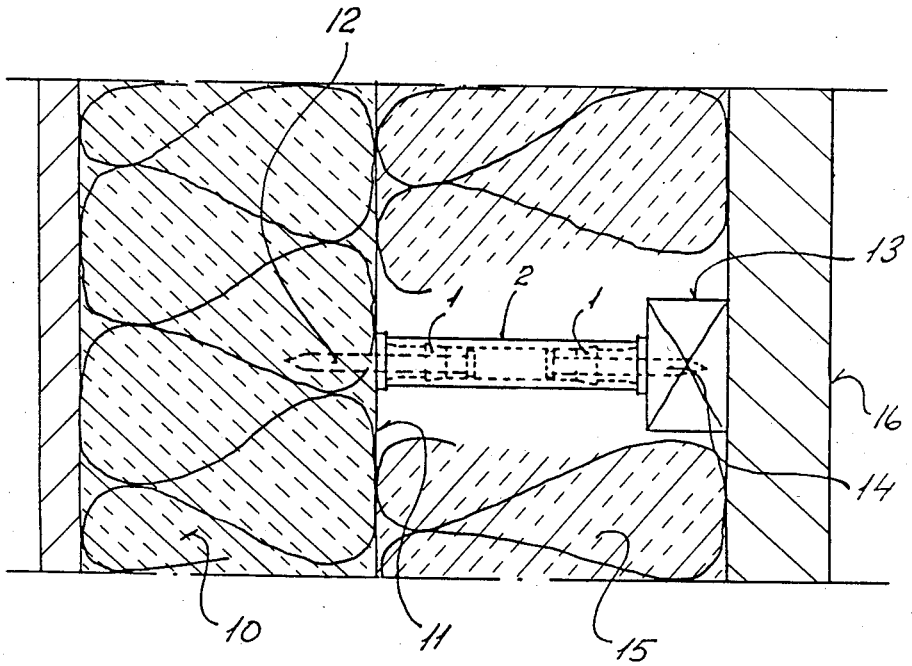

FIG. 5 illustrates a cladding of a stud framework for supplementary insulation and this is of essentially the same design as the application in FIG. 4, although the covering panel 16 has been replaced by two panels of a suitable material. The same reference numerals are employed for the same parts in the different Drawing figures.

Figure 6:
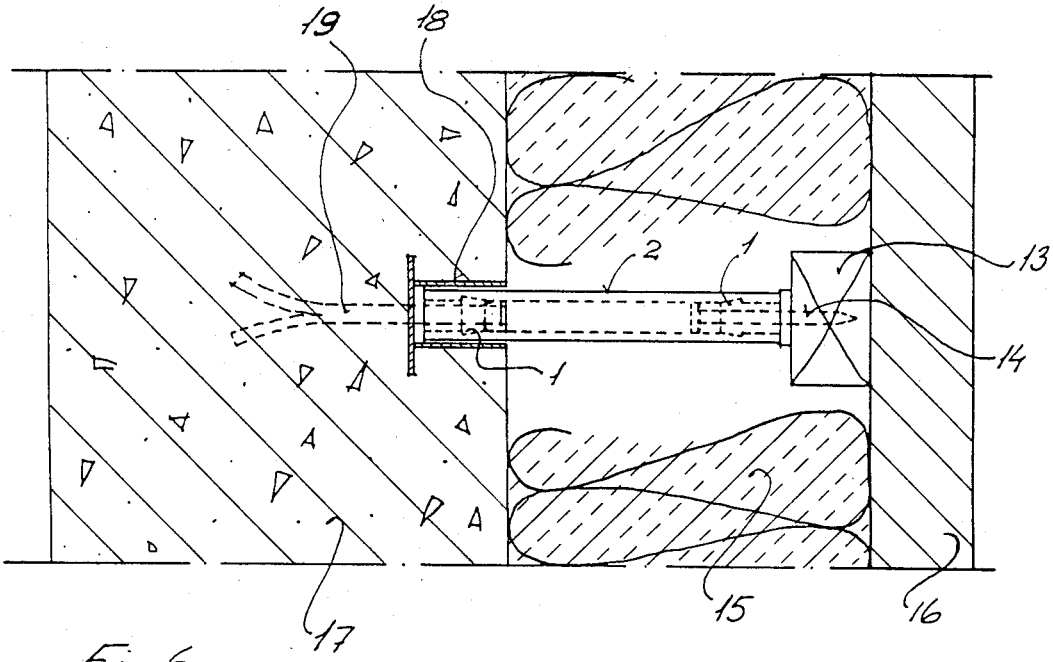

FIG. 6 illustrates an application of the device according to the present invention for the supplementary insulation of a concrete wall 17. So as to realise the desired stability and strength, the plugs 1 are placed in bottom holes 18 in the concrete wall 17, in which holes the plugs 1 are anchored by suitable anchorage members 19 which may be of any optional, appropriate construction. Otherwise, this application is executed fundamentally in the same manner as the previously described applications, for which reason it will not be described in greater detail.

Figure 7:
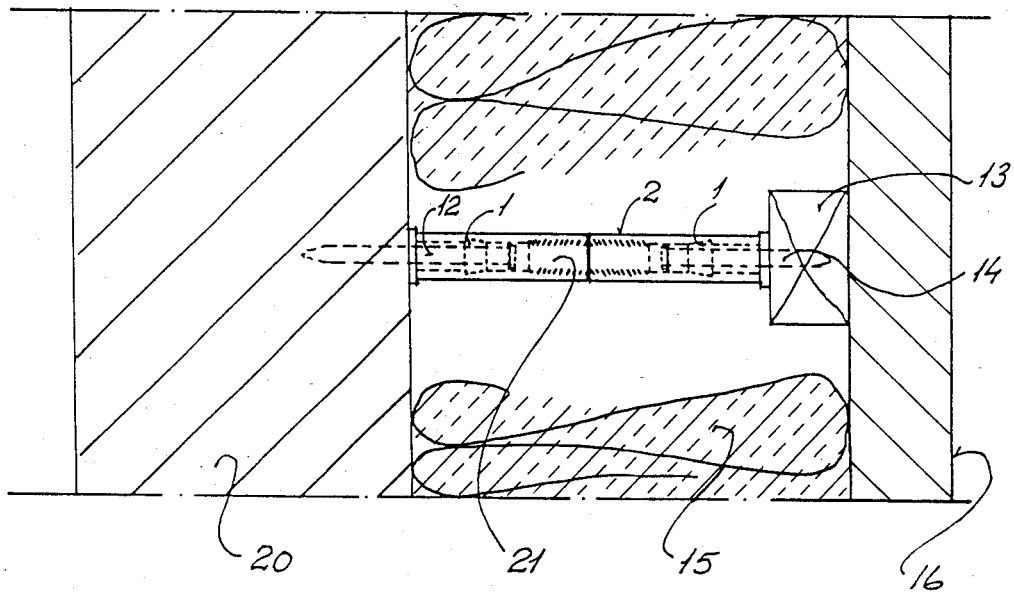

FIG. 7 illustrates the application of a device according to the present invention for cladding an extant wall 20, both for supplementary insulation and for alignment. This application differs from, for example, the application of FIG. 5 only in that the spacer 2 is split into two parts, the length of these parts being adapted to attain the desired alignment of the wall 20, whereafter the parts are anchored to one another using a suitable anchorage member 21 which, quite simply, may consist of a plastic plug which is fixedly glued into the parts of the spacer 2. Naturally, the parts 2 may be interiorly threaded, while the member is exteriorly threaded so as to obtain an optional and simple adjustability of the length of the spacer. After adjustment of the length of the spacer, the positions of the parts may be fixed in some suitable manner with the help of, for example, glue.

In the application according to FIGS. 4 to 7, the insulation panels are so dimensioned that they are urged into contact with one another between the spacers, this operation being facilitated by means of a notch along the edge of the batten or stud 13.

Figure 8:
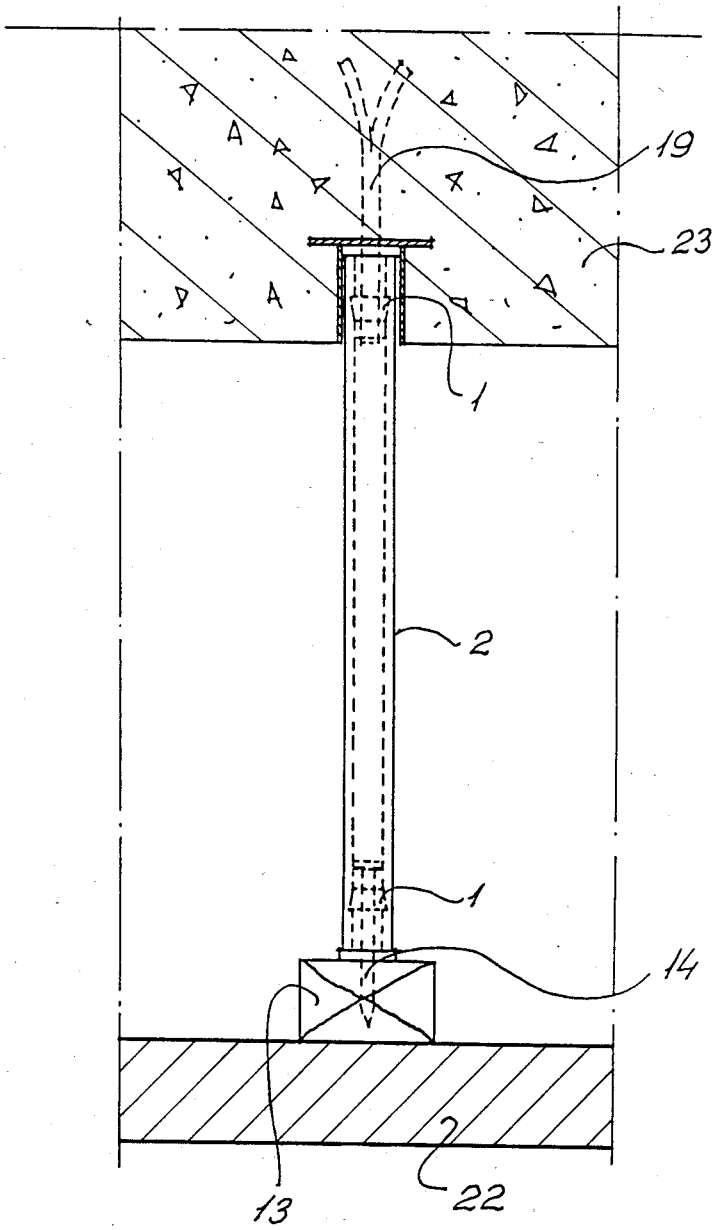

FIG. 8 illustrates an application of a further device according to the present invention which differs from the applications illustrated in FIGS. 4 to 7. In this case, the device is employed according to the present invention for the suspension of a false ceiling 22 in an extant roof 23 of concrete or the like. Generally speaking however, this application corresponds to the application according to FIG. 6, although no insulation is placed between the concrete roof 23 and the false ceiling 22.

As has been mentioned above, a device according to the present invention makes for a high degree of versatility and it should, on this point, be observed that the plugs 1 may very well be anchored by means of other retaining devices than nails; for example screws, bolts or the like. Naturally, it is also conceivable to anchor the plugs 1 by means of a suitable glue in those cases where such an operation is deemed appropriate. The engagement between the parts may also be realised by crimping of the spacer on the plug or plugs. The device according to the invention may also be used for anchoring, for example, cavity walls of half-brick or the like. In this case, the one plug may be in the form of an anchorage member suitable for the contemplated purpose.

The invention should not be considered as restricted to that described above and shown on the Drawings, many modifications being possible without departing from the spirit and scope of the appended claims.

I claim:

1. A device for anchoring a first element to a second element, said elements being spaced apart with respect to one another, comprising; a cylindrical plug-like member having a longitudinal bore for receiving a fastener which anchors said plug-like member to said first element, a spacer adapted to be fixed to the second said element; said plug-like member and said spacer having ends which are provided with mutually cooperable snap-like locks which are operable to connect the plug-like member and the spacer and their associated elements to one another, said plug-like member having a foot for abutting against said first element, said spacer having at at least one end a hole dimensioned so as to receive said plug-like member.

2. The device as recited in claim 1, wherein one plug-like member is fixed to each element, said spacer having a said hole at both of its ends dimensioned to receive each of said plug-like members.

3. The device as recited in claim 1, wherein the plug-like member has a conical portion at the end opposite to said foot, a portion of said spacer between said conical portion and said foot being of lesser diameter than the largest diameter of said conical portion, said spacer having a recess corresponding to said conical portion.

4. The device as recited in claim 3, wherein the said portion of said spacer between said conical portion and said foot forms an angle with the base of said conical portion, said angle being equal to 90°.

5. The device as recited in claim 3, wherein said portion of said spacer between said conical portion and said foot forms an angle with the base of said conical portion, said angle being less than 90°.

6. The device as recited in claim 1, wherein the spacer is tubular.

7. The device as recited in claim 6, wherein the tubular spacer is split in two parts; and wherein a connecting piece is disposed between the two parts.

* * * * *